US006690623B1

(12) United States Patent
Maano

(10) Patent No.: US 6,690,623 B1
(45) Date of Patent: Feb. 10, 2004

(54) MULTI-FUNCTIONAL TIME INDICATING DEVICE WITH A MULTI-COLORED FIBER OPTIC DISPLAY

(76) Inventor: Arnold K. Maano, P.O. Box 11163, Honolulu, HI (US) 96828

( * ) Notice: Subject to any disclaimer, the term of this patent is extended or adjusted under 35 U.S.C. 154(b) by 0 days.

(21) Appl. No.: 10/291,331

(22) Filed: Nov. 8, 2002

(51) Int. Cl.[7] ..... G04C 19/00; G04C 17/00; G04B 19/00

(52) U.S. Cl. ..... 368/82; 368/84; 368/223; 368/241

(58) Field of Search ..... 368/82, 84, 223, 368/239–242

(56) References Cited

U.S. PATENT DOCUMENTS

| | | | | | |
|---|---|---|---|---|---|
| 1,356,929 | A | | 10/1920 | Lewers | |
| 3,757,511 | A | * | 9/1973 | Burgess et al. | 368/83 |
| 4,028,876 | A | | 6/1977 | Delatorre | |
| 4,525,077 | A | * | 6/1985 | Ketner | 368/77 |
| 4,540,242 | A | * | 9/1985 | Shibuya et al. | 349/83 |
| 4,702,615 | A | | 10/1987 | Havel | |
| 4,752,919 | A | * | 6/1988 | Clark | 368/223 |
| 4,885,731 | A | | 12/1989 | Massaro | |
| 4,920,524 | A | * | 4/1990 | Kotob | 368/240 |
| 5,008,870 | A | * | 4/1991 | Vessa | 368/242 |
| 5,199,009 | A | * | 3/1993 | Svast | 368/240 |
| 5,228,013 | A | | 7/1993 | Bik | |
| 5,253,228 | A | * | 10/1993 | Truett | 368/82 |
| 5,526,327 | A | * | 6/1996 | Cordova, Jr. | 368/82 |
| 5,694,376 | A | * | 12/1997 | Sullivan | 368/82 |
| 5,818,798 | A | * | 10/1998 | Luchun | 368/281 |
| 5,896,348 | A | * | 4/1999 | Lyon | 368/223 |
| 5,995,456 | A | * | 11/1999 | Brewer et al. | 368/84 |
| D419,600 | S | | 1/2000 | Marasca | |
| 6,198,698 | B1 | | 3/2001 | Graves | |
| 6,354,841 | B1 | | 3/2002 | Bradt | |
| 6,504,590 | B1 | * | 1/2003 | Kikuchi et al. | 349/113 |
| 6,556,513 | B2 | * | 4/2003 | Wimberly | 368/82 |

* cited by examiner

*Primary Examiner*—Randy Gibson
*Assistant Examiner*—Michael L. Lindinger
(74) *Attorney, Agent, or Firm*—John D. Gugliotta; Olen L. York, III

(57) ABSTRACT

A multi-functional timepiece with multicolor time display is a watch or free-standing clock in which the current time is determined by the use of a series of colored lights around the face of the watch. The face has the current layout associated with conventional watches, with the number 12 on top and numbers 1–11 evenly spaced around the perimeter. However, in lieu of hour hands, minute hands and second hands, the invention uses a series light to indicate the time. A group of red lights indicate the hour, a series of yellow lights indicate the minutes, and a series of green lights indicates the seconds. The light is transmitted from a central source via fiber optic tubes. Other functions such as day and date indications are provided in the conventional manner.

15 Claims, 7 Drawing Sheets

MULTI-FUNCTIONAL TIME INDICATING DEVICE WITH A MULTI-COLORED FIBER OPTIC DISPLAY

RELATED APPLICATIONS

The present invention was first described in Disclosure Document Registration 512,397 filed on May 30, 2002 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates to time indicating devices, and more particularly a multi-functional time indicating device having a multi-colored display transmitted through fiber optic communication.

2. Description of the Related Art

There are a multitude of timepieces, especially wrist watches or free-standing clocks, displaying the time in analog or digital format. Other timepieces illustrate time change via non-numerical means, such as the expanding pie chart in U.S. Pat. No. 6,198,698. Beyond the functional aspects of such wrist watches, the varying styles offer trendy alternatives to the traditional appearances society has grown accustomed to. As such, new styles and formats of timepieces are a necessary ingredient in influencing the timepiece industry.

A search of the prior art did not disclose any patents that read directly on the claims of the instant invention; however, the following references were considered related:

U.S. Pat. No. 6,354,841, issued in the name of Bradt, discloses an educational toy clock having a plurality of discs of varying colors and numbers;

U.S. Pat. No. 6,198,698, all issued in the name of Graves, discloses a time indication device illuminated to indicate the hour and minute, wherein the hour is in Arabic or Roman numerals and the minute is displayed as an expanding pie chart;

U.S. Pat. No. 5,228,013, issued in the name of Bik, discloses a microelectronic apparatus having a color changing display to indicate time;

U.S. Pat. No. 4,885,731, issued in the name of Massaro, discloses an analog timepiece for children having an inner ring of hour numerals, an outer ring of minute numerals, and at least one transparent hand;

U.S. Pat. No. 4,702,615, issued in the name of Havel, discloses a timekeeping device that measures time and provides a variable color coordinated display for exhibiting analog translation of measured time;

U.S. Pat. No. 4,028,876, issued in the name of Delatorre, discloses an apparatus for altering the color characteristic of a thermoplastic film due to ambient environmental temperature change;

U.S. Pat. No. 1,356,929, issued in the name of Lewers, discloses an educational clock having removable blocks for teaching a child how to tell time in both Roman and Arabic numerals; and U.S. Pat. No. D 419,600, issued in the name of Marasca, discloses a design for a teaching timepiece having an hour hand, a longer minute hand, hour and minute hashes along the facial perimeter, hour numerals along the inside of the hashes, minutes numerals along the outside of the hashes and a digital display of the time.

Accordingly, there is a continual need for new and innovative features and improvements that will serve to enhance the timepiece industry.

SUMMARY OF THE INVENTION

Therefore, it is an object of the invention to provide an improved timepiece apparatus having a multi-functional capacity and a multicolored display.

It is a feature of the present invention to provide a fashionable clothing accessory.

Briefly described according to one embodiment of the present invention, a multi-functional timepiece with multicolor time display is a watch or free-standing clock in which the current time is determined by the use of a series of colored lights around the face of the watch. The face has the current layout associated with conventional watches, with the number 12 on top and numbers 1–11 evenly spaced around the perimeter. However, in lieu of hour hands, minute hands and second hands, the invention uses a series light to indicate the time. A group of red lights indicate the hour, a series of yellow lights indicate the minutes, and a series of green lights indicates the seconds. The light is transmitted from a central source via fiber optic tubes. Other functions such as day and date indications are provided in the conventional manner. The use of the multi-functional watch with multicolor display will serve as a fashion statement that complements any look as well as being a conversation starter.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
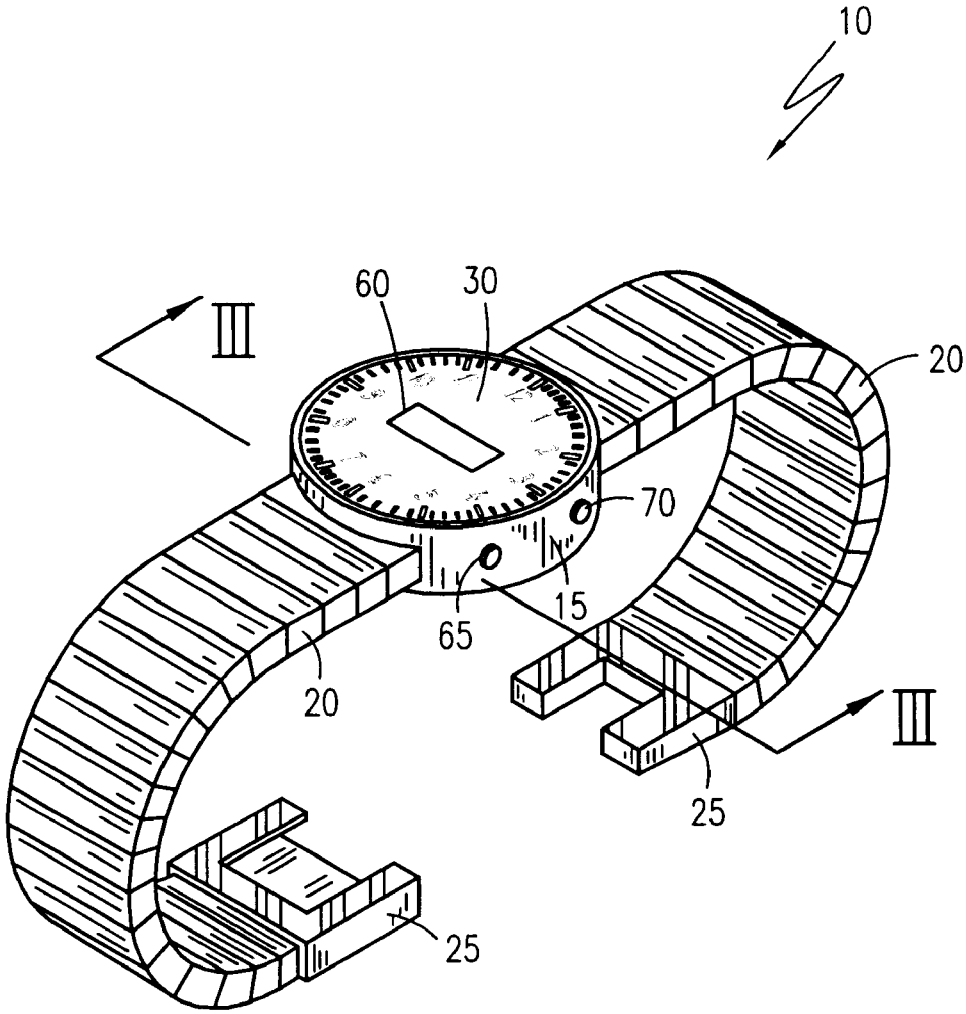
FIG. 1 is a perspective view of a multi-functional, multicolored timepiece.

10 time indicating device
15 watch body
20 strap
25 fastening means
30 watch face
35 hour indicia
40 fiber optic cable ends
43 transparent illumination cover
45 current hour number
50 current minute number
55 current second number
60 current day/date display
65 first time setting means
70 second time setting means
75 clock body
80 movement direction arrow
85 battery
90 main controller
95 crystal oscillator
100 frequency dividing network
105 first output
110 lamp driver module
115 tri-color light emitting diodes
120 second output
125 day/date controller
130 day/date display
135 fiber optic cable segment
150 minutes half
155 seconds half
160 hour third
165 minutes third
170 seconds third

DESCRIPTION OF THE PREFERRED EMBODIMENTS

The best mode for carrying out the invention is presented in terms of its preferred embodiment, herein depicted within the FIGS. 1–10.

1. Detailed Description of the Figures

Figure 2:
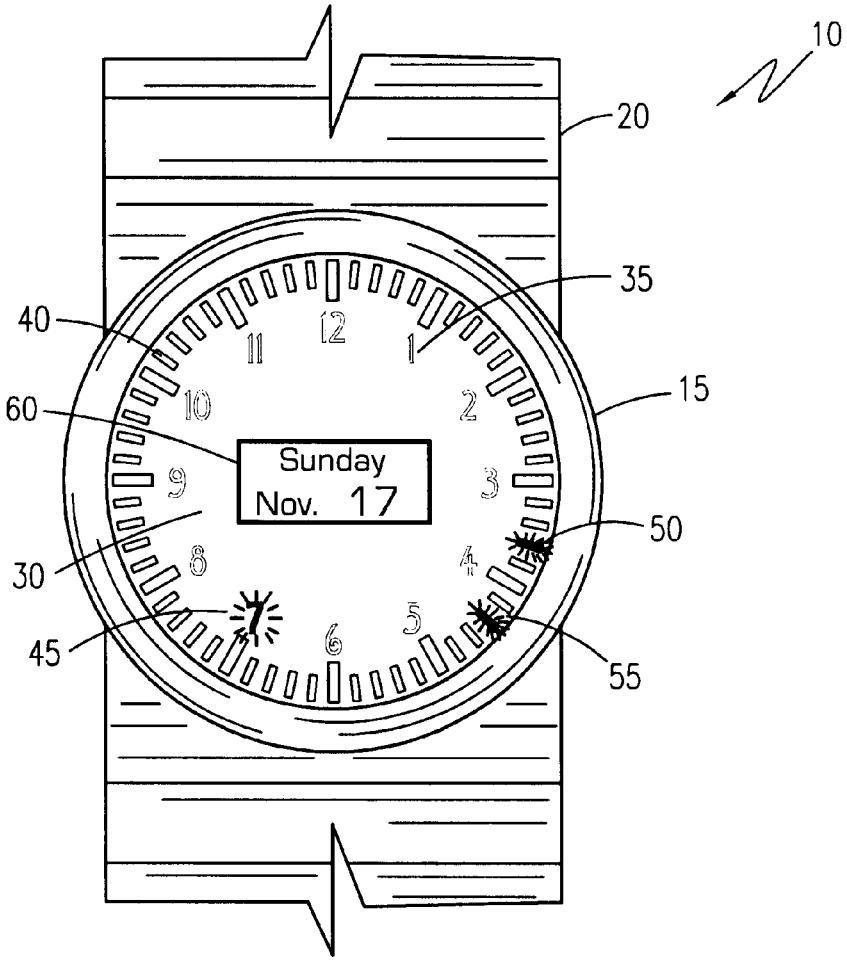
FIG. 2 is a front view of the face of the timepiece shown in FIG. 1, illustrating the illumination of numerals and hashes.
Figure 3:
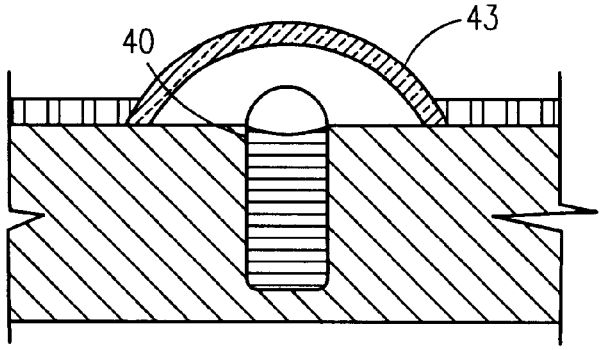
FIG. 3 is a cross-sectional view of a fiber optic end and a domed illumination cover, taken along the line III—III of FIG. 1.

Referring now to FIG. 1 through FIG. 3, a time indicating device with a multi-colored fiber optic display 10 is disclosed, according to the preferred embodiment of the present invention. The preferred embodiment of the present invention discloses an electronic timepiece. A watch body 15, complete with a strap 20 and a fastening means 25, such as a snap fastener, a clasp or buckle, as would be found on a conventional watch is indicated. A watch face 30 complete with hour indicia 35, as arranged in a circular pattern as would be found on a conventional watch, is supplied on the upper portion of the watch body 15. A series of fiber optic cable ends 40 is located around the perimeter of the watch face 30 in a circular pattern as shown. The fiber optic cable ends 40 sets adjacent to a transparent illumination cover 43, which may be glass or plastic, and depicted here as having a domed-shape, although it is envisioned that the illumination cover 43 may have other geometrical shapes. The total number of fiber optic cable ends 40 is to be sixty, corresponding to the number of seconds in a minute or the number of minutes in an hour. A current hour number 45, corresponding to the actual hour of the actual time, is supplied in an illuminated manner as shown. The color of the illumination is RED. The current hour number 45, in the case of this FIG. is indicated as the seventh hour is illuminated for illustrative purposes, but could also equally be any of the other eleven hour indicia 35. The illumination method of the current hour number 45 is a tri-colored light emitting diode 115, which will be described in greater detail herein below. As the current hour number 45 is illuminated in RED, a current minute number 50 is illuminated in YELLOW. In the case of this FIG., the current minute number 50 as a time of approximately eighteen (18) minutes past the hour. This current minute number 50 will advance in a clockwise rotational manner as customarily expected. In the case where the current hour number 45 and the current minute number 50 are the same numerical value, it is envisioned that the corresponding fiber optic cable ends 40 will flash RED and YELLOW in an alternating manner. Lastly, a current second number 55 is illuminated GREEN. In the case of this FIG., the current second number 55 indicates a time of approximately twenty-two (22) seconds into the current minute. The current second number 55 will advance in a clockwise rotational manner as customarily expected. In the case where the current hour number 45 and the current second number 55 are the same numerical value, it is envisioned that the corresponding fiber optic cable ends 40 will flash RED and GREEN in an alternating manner. In the case where the current minute number 50 and the current second number 55 are the same numerical value, it is envisioned that the corresponding fiber optic cable ends 40 will flash YELLOW and GREEN in an alternating manner. In the case where the current hour number 45, the current minute number 50, and the current second number 55 are the same numerical value, as will occur once an hour, the corresponding fiber optic cable ends 40 will flash RED, YELLOW, and GREEN in an alternating manner. Also, a current day/date display 60 is located in the center of the watch face 30. The current day/date display 60 is envisioned to be of the liquid crystal display (LCD) variety, however, those familiar in the art realize that other methods such as a mechanical readout, Light Emitting Diodes (LED), Thin Film Transistor, Plasma, and other display methods would work equally well, and as such, should not be interpreted as a limiting factor of the present invention. Finally, shown in FIG. 1, is a first time setting means 65 and a second time setting means 70, which are envisioned to be switches. Both the first time setting means 65 and the second time setting means 70 would be utilized in the initial setting of the current time on the time indicating device with a multi-colored fiber optic display 10. It is envisioned that the first time setting means 65 would either select the hour, the minute, the second, the day/date or reset in a rotational pattern and the second time setting means 70 would be used to advance either the respective hour, minute, second, or day/date in a manner found similar to that used when setting a conventional watch.

Figure 4:
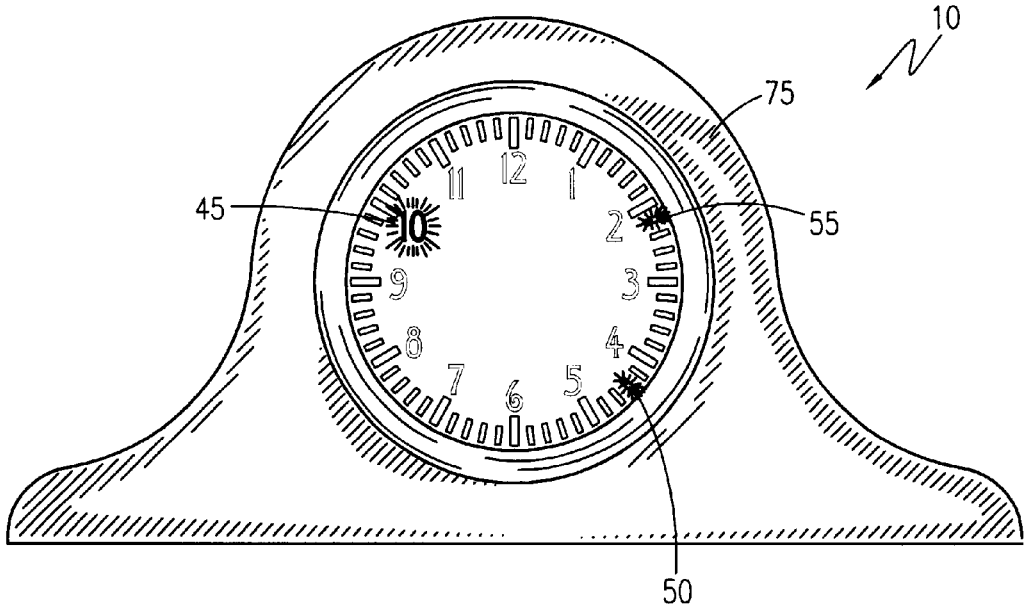
FIG. 4 is a front view of an alternative embodiment, herein depicted as a desk clock, and having similar facial features to the wrist watch depicted in FIG. 1.

Referring next to FIG. 4, an alternate embodiment of the present invention, a clock incorporating the technology and time telling method of the present invention is shown. In this embodiment the watch face 30 is shown mounted to a clock body 75. For purposes of illustration, the clock body 75 is shown as a mantle clock, but any type of stationary clock, such as a table clock, a wall clock, a grandfather clock, or the like could be equipped with the time telling characteristics of the time indicating device with a multi-colored fiber optic display 10 as described in FIG. 1. The current hour number 45 in this FIG. is shown as the numeral "10". The current minute number 50 in this FIG. is shown as the numeral "22". The current second number 55 in this FIG. is shown as the numeral "11". Thus, the corresponding time indicated is 10:22:11. The feature of illumination of the current hour number 45, the current minute number 50 and the current second number 55 with RED, YELLOW and GREEN colors respectively is viewed as being especially advantageous in this embodiment due to its ability of being able to tell the time in low or no-light situations, due to the fact that most common stationary clocks with mechanical movements are not illuminated.

Figure 5A:
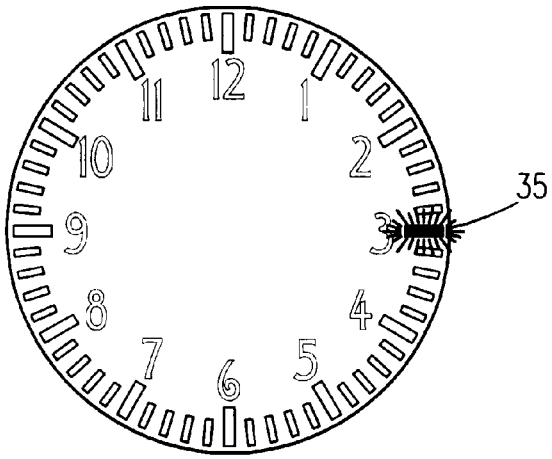
FIG. 5*a* is a front view of a timepiece, indicating the time as 3:00.

Referring now to FIG. 5*a*, to indicate 3:00:00, the fiber optic cable ends 40 nearest the hour indicia 35 of the numeral "3" is illuminated in an alternating RED, YELLOW, and GREEN arrangement.

Figure 5B:
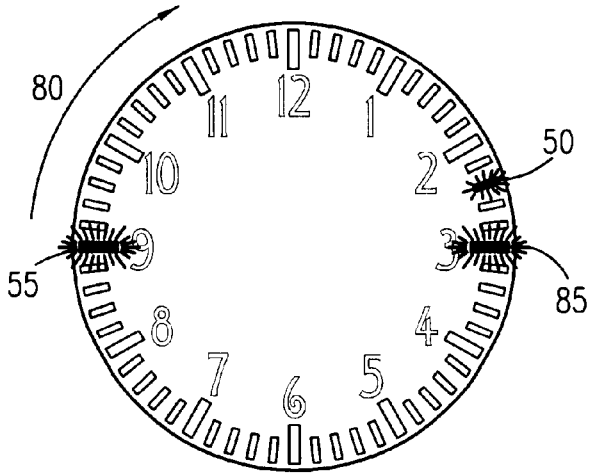
FIG. 5*b* is a front view of a timepiece, indicating the time as 3:12:45.

Referring next to FIG. 5*b*, a time 12 minutes and 45 seconds after the time disclosed in FIG. 5*a* is depicted. The fiber optic cable ends 40 nearest the hour indicia 35 of the numeral "3" is illumined in a RED arrangement. The fiber optic cable ends 40 at a point ⅖ of the way between the hour indicia 35 of the numerals "2" and "3", and labeled as 50, is illuminated in a YELLOW arrangement. Finally, the fiber optic cable ends 40 nearest the hour indicia 35 of the numeral "9" is illuminated in a GREEN arrangement, and labeled as 55. The various illuminated arrangements move in a rotational pattern as time passes as indicated by a movement direction arrow 80, as expected of a conventional watch or clock.

Figure 5C:
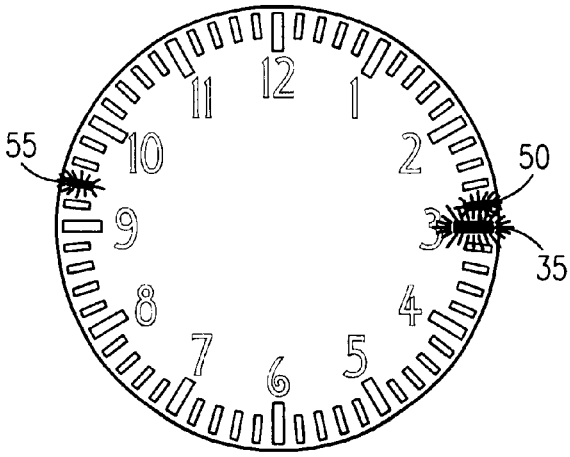
FIG. 5*c* is a front view of a timepiece, indicating the time as 3:47:14.

Referring now to FIG. 5*c*, a time 47 minutes and 14 seconds after the time disclosed in FIG. 5*a* is depicted. The fiber optic cable ends 40 nearest the hour indicia 35 of the numeral "3" is illumined in a RED arrangement. The fiber optic cable ends 40 at a point ⅖ of the way between the hour indicia 35 of the numerals "9" and "10" is illuminated in a YELLOW arrangement. Finally, the fiber optic cable ends 40 at a point ⅘ of the way between the hour indicia 35 of the numerals "2" and "3" is illuminated in a GREEN arrangement.

Figure 6:
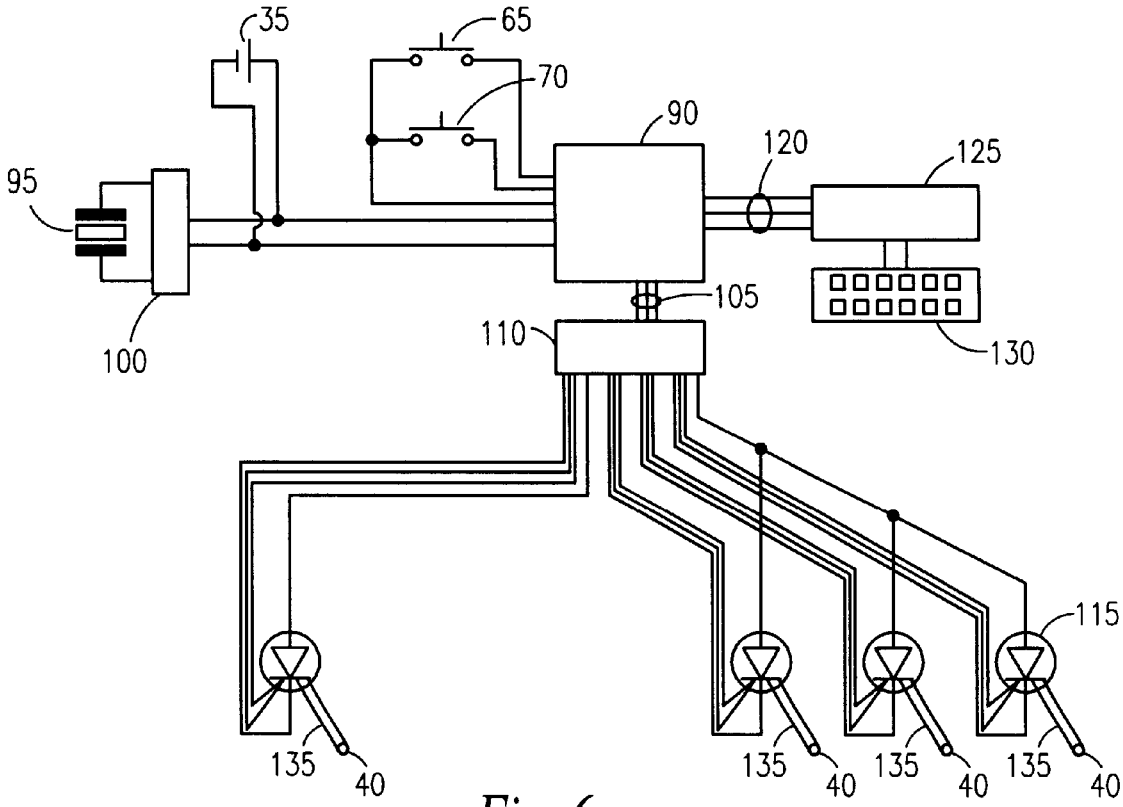
FIG. 6 is a electrical schematic block diagram illustrating the electrical circuitry necessary to power the present invention.

Referring finally to FIG. 6, an electrical schematic block diagram depicting the circuitry associated with the time indicating device with a multi-colored fiber optic display 10 is disclosed. Electrical power for the time indicating device with a multi-colored fiber optic display 10 is provided by a battery 85. Power is routed to a main controller 90 which provides the main controlling function of the time indicating device with a multi-colored fiber optic display 10. The operation and configuration of the main controller 90 is well known in the art, and is not expanded here for purposes of clarity. Power is also routed to a combination of a crystal oscillator 95 and a frequency dividing network 100 which provides the time keeping function. The crystal oscillator 95 oscillates at a high frequency rate in a continuous manner at a very steady state. The frequency dividing network 100 serves to divide or count the frequency pulses at a rate to allow the main controller 90 to provide for the advancement of minutes and hours. The operation of the crystal oscillator 95 and the frequency dividing network 100 is well known in the art, and is not expanded here for purposes of clarity. Additionally, the first time setting means 65 and the second time setting means 70 allow for the setting of the current time in the manner aforementioned described in FIG. 1. A first output 105 from the main controller 90 drives a lamp driver module 110. It is envisioned that the lamp driver module 110 would be a binary coded decimal (BCD) to decimal driver. The output drives a plurality of tri-color light emitting diodes 115, envisioned to be a total quantity of sixty (60) of which only a portion are represented here for the sake of clarity. Each tri-color light emitting diode 115 is shown as three anode/cathode combinations in single die, such that energization of each discrete set will result in light of a specific wavelength being emitted. However it should be noted that tri-color light emitting diodes 115 of three or even two wire packages are possible. By the application of reverse polarity, a single LED can generate red and green colors, and the application of an alternating current will result in a yellow color. A second output 120 from the main controller 90 drives a day/date controller 125 which activates various display segments in a day/date display 130 for the display of the respective day and/or date. Finally, a plurality of fiber optic cable segment 135, envisioned to be a total quantity of sixty (60), of which only a portion are represented here for the sake of clarity, and are shown with their respective fiber optic cable ends 40. The fiber optic cable segment 135 allows for the routing of the light rays from the tri-color light emitting diodes 115 to the watch face 30 (as shown in FIG. 1) without regard to physical spacing or location between the two. While the above description of the electrical circuit is primarily direct at the preferred embodiment configuration of the watch as shown in FIG. 1. Minor changes well known in the art allow for similar circuitry to control the time indicating device with a multi-colored fiber optic display 10 as provided with the alternate embodiment as depicted in FIG. 4. These changes include electrical power from house current and a power supply in lieu of batteries, a frequency-based time keeping regulator in lieu of a crystal-based controller, and mechanically based or other electrically based methods of illuminating devices and/or surfaces as earlier described. Furthermore, the display format may be changed from a steady, non-blinking format to an intermittent flashing, or blinking, format, via the selection buttons 65 or 70.

Figure 7:
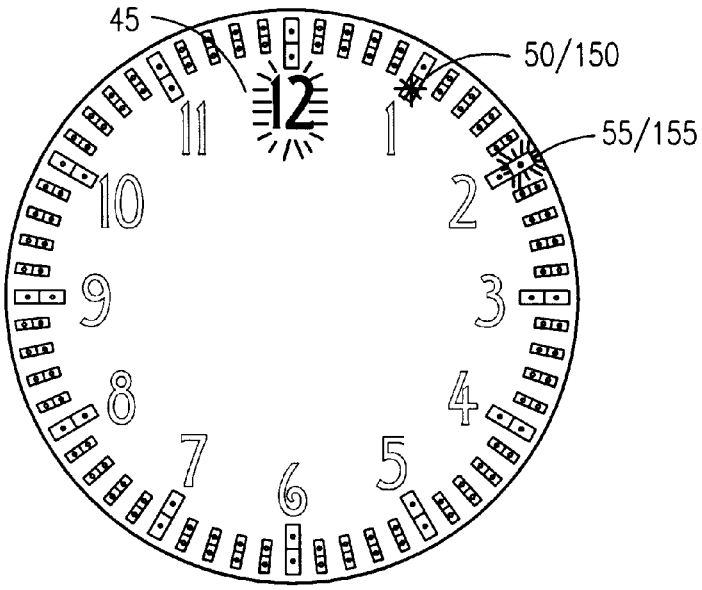
FIG. 7 is a front view of an alternative embodiment, wherein the illumination cover for the minutes and seconds is divided into halves, thereby allowing for a dual diode illumination system in which the minutes and seconds are independently illuminated.
Figure 8:
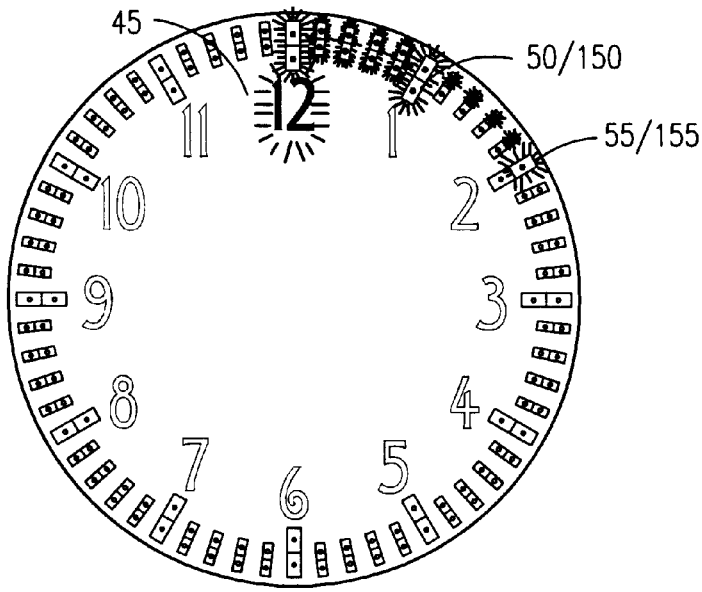
FIG. 8 is a front view of another alternative embodiment, depicting a cumulative illumination trail wherein the previous minutes and seconds remain lit.

Referring now to FIG. 7, an alternate embodiment of the present invention is shown. The current hour number 45 is shown and is illuminated in the same manner as depicted in FIG. 2 and described above. The current minute number 50 and the current second number 55 are shown as having a dual diode system in which the illumination cover 43 has two halves, a minutes half 150 and a seconds half 155. The time of 12:05:10 is shown in FIG. 7, wherein the numeral "12" is lit, the minutes half 150 depicts "5 minutes passed the hour," and the seconds half 155 depicts "10 seconds passed the minute." Alternately, instead of the previous minutes half 150 or seconds half 155 becoming unlit after that time has passed, the previous minutes and seconds halves 150 and 155, respectively, may remain lit and display the minutes and seconds as a cumulative lighting trail as depicted in FIG. 8. FIG. 8 displays the same time as FIG. 7 (12:05:10), but has the cumulative lighting trail indicating the past minutes and seconds as well as the current minute and second.

Figure 9:
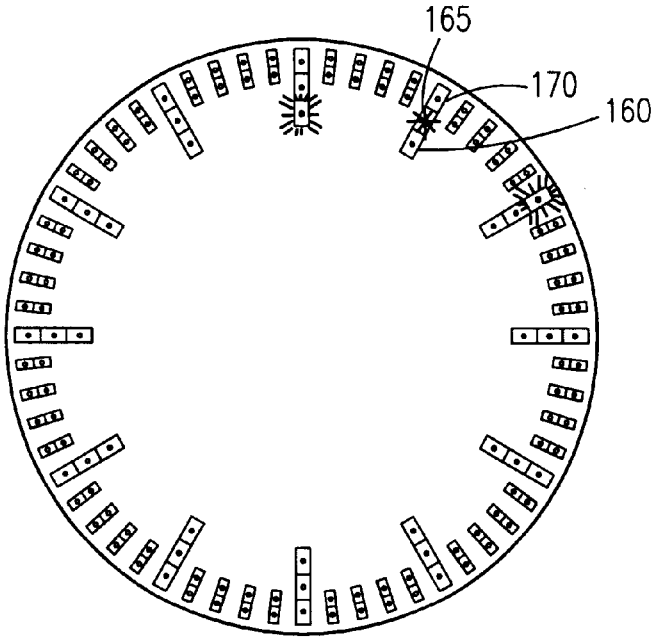
FIG. 9 is a front view of another alternative embodiment, depicting the illumination cover as divided into thirds and with the hour numeral missing, thereby allowing for a triple diode illumination system in which the hours, minutes and seconds are independently illuminated.
Figure 10:
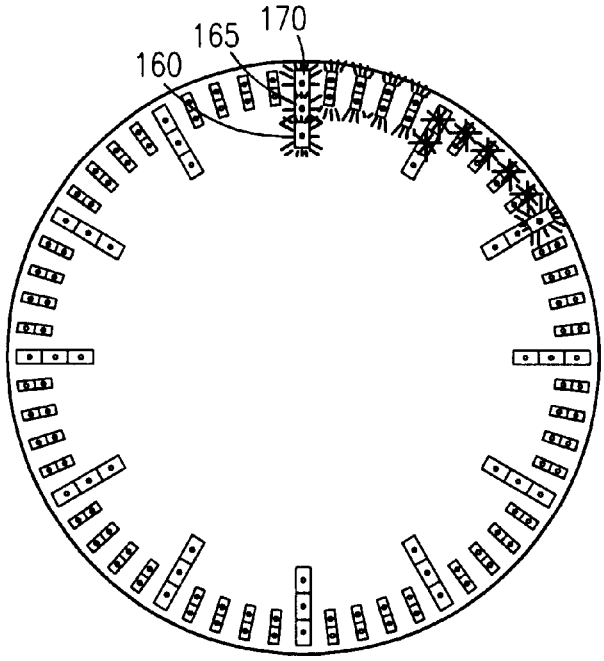
FIG. 10 is a front view of another alternative embodiment, depicting a cumulative illumination trail, as depicted in FIG. 8, but incorporated into the embodiment of FIG. 9, in which the hour numeral is absent.

Referring now to FIG. 9, another alternate embodiment of the present invention is shown. In FIG. 9, the hour numerals 45 have been replaced by a larger illumination cover 43 divided into thirds; an hour third 160, a minutes third 165, and a seconds third 170. The intervening illumination covers 43, indicating the minutes and seconds, remain as described in FIG. 7 and FIG. 8. Thus, if the hour is "12", then the hour third 160 is illuminated and remains illuminated until that hour expires. FIG. 9 depicts the time as in FIG. 7 and FIG. 8 (12:05:10), wherein the hour third 160 is illuminated at the "12 hour" position, the minutes third 165 illuminated at the "5 minute" position, and the seconds third 170 is illuminated at the "10 second" position found on the wrist watch displays described above. Alternately, FIG. 10 depicts the cumulative lighting trail as previously described in FIG. 8, absent the hour numeral 45.

It is envisioned that other styles and configurations of the present invention can be easily incorporated into the teachings of the present invention, and only one particular configuration will be shown and described for purposes of clarity and disclosure and not by way of limitation of scope.

2. Operation of the Preferred Embodiment

The present invention is designed with ease of operation features in mind that allow it to be set and utilized by a common individual with little or no training, and operated in a transparent and intuitive manner with respect to conventional time keeping pieces.

To use the present invention, the user would set the correct time on the time indicating device with a multi-colored fiber optic display 10 using the appropriate first time setting means 65 or the second time setting means 70 to illuminate the proper current hour number 45, the proper current minute number 50 and the proper current second number 55 along with the proper day and date on the current day/date display 60. At this point the time indicating device with a multi-colored fiber optic display 10 is ready to be utilized to indicate the correct time to any individual wearing or viewing the illuminating, visual, time indicating device 10.

To determine the correct time, the user finds the current hour number 45 nearest the fiber optic cable ends 40 with the RED color. Next the current minute number 50 is determined by locating the nearest fiber optic cable ends 40 with the YELLOW color. Finally, the current second number 55 is determined by locating the nearest current day/date display 60 with the GREEN color. This allows for the determination of the current time as depicted in the examples in FIGS. 5*a*, 5*b*, and 5*c*. Operation of the various three colors is identical to that found when determining time on a conventional time piece with three hands.

The foregoing description is included to illustrate the operation of the preferred embodiment and is not meant to limit the scope of the invention. The scope of the invention is to be limited only by the following claims.

What is claimed is:

1. A time indicating device comprising:

a watch body forming a perimeter;

a strap and a fastening means depending from said body;

a watch face having an numerical hour indicia and minutes and seconds indicia arranged in a circular pattern as would be found on a conventional watch, wherein said minutes and seconds indicia number sixty;

a plurality of fiber optic cable ends located around said perimeter of said watch face in a circular pattern corresponding to each of said numerical hour indicia and said minutes and seconds indicia; and a plurality of transparent illumination covers, wherein said plurality of fiber optic cable ends set adjacent to and transmit light through said illumination covers and illuminating said illumination covers and separately illuminating said numerical hour indicia and said minutes and seconds indicia.

2. The time indicating device of claim 1, wherein an illumination method of said numerical hour indicia and said minutes and seconds indicia comprises a tri-colored light emitting diode.

3. The time indicating device of claim 2, wherein the current hour number is illuminated in RED, a current minute number is illuminated in YELLOW, and a current second number is illuminated GREEN.

4. The time indicating device of claim 3, further comprising:

a current day and date display located in the center of said watch face, said display being of a liquid crystal display (LCD) variety.

5. The time indicating device of claim 2, further comprising:

time setting means for setting of the current time on said time indicating device.

6. The time indicating device of claim 1, wherein said multi-colored fiber optic display is provided by a battery and wherein power is routed to a main controller which provides the main controlling function.

7. The time indicating device of claim 6, wherein power is also routed to a combination of a crystal oscillator and a frequency dividing network which provides time keeping function, said crystal oscillator oscillating at a high frequency rate in a continuous manner at a very steady state and said frequency dividing network divides or counts the frequency pulses at a rate to allow said main controller to provide for the advancement of minutes and hours.

8. The time indicating device of claim 7, wherein a first output from said main controller drives a lamp driver module comprising a binary coded decimal (BCD) to decimal driver that drives a plurality of tri-color light emitting diodes.

9. The time indicating device of claim 8, wherein each tri-color light emitting diodes has three anode and cathode combinations in single die, such that energization of each discrete set will result in light of a specific wavelength being emitted.

10. The time indicating device of claim 1, wherein said transparent illumination covers are divided into minutes halves and seconds halves, said minutes halves and said seconds halves illuminated by independent fiber optic cable ends.

11. The time indicating device of claim 10, wherein said minutes halves and seconds halves are illuminated in an advancing manner, wherein the previously indicated minute and second are not illuminated.

12. The time indicating device of claim 10, wherein said minutes halves and seconds halves are illuminated in a cumulative illumination trail, wherein the previous minutes and seconds are illuminated until the current minute or hour expires.

13. The time indicating device of claim 1, wherein said transparent illumination covers are divided into hour thirds, minutes thirds and seconds thirds, said hour thirds, minutes thirds and said seconds thirds illuminated by independent fiber optic cable ends.

14. The time indicating device of claim 13, wherein said hour thirds, minutes thirds and seconds thirds are illuminated in an advancing manner, wherein the previously indicated minute and second are not illuminated.

15. The time indicating device of claim 13, wherein said hour thirds, minutes thirds and seconds thirds are illuminated in a cumulative illumination trail, wherein the previous minutes and seconds are illuminated until the current minute or hour expires.

* * * * *